United States Patent [19]

Bange

[11] 4,223,829

[45] Sep. 23, 1980

[54] CYCLICAL CENTRIFUGAL MACHINE

[75] Inventor: Joseph B. Bange, Hamilton, Ohio

[73] Assignee: The Western States Machine Company, Hamilton, Ohio

[21] Appl. No.: 257

[22] Filed: Jan. 2, 1979

[51] Int. Cl.[2] ..... B04B 9/10

[52] U.S. Cl. ..... 233/24; 192/0.02 R; 192/0.032; 192/113 B; 127/19; 192/12 C

[58] Field of Search ..... 233/23 R, 24, 7, 1 R; 192/0.03, 0.032, 0.02 R, 0.049, 0.075, 0.076, 3 R, 12 C, 12 R, 58 C, 113 B, 0.02; 127/19, 56

[56] References Cited

U.S. PATENT DOCUMENTS

| | | | |
|---|---|---|---|
| 2,129,992 | 9/1938 | De Mattia | 233/23 R |
| 3,696,898 | 10/1972 | Sommer | 192/58 C |
| 3,971,461 | 7/1976 | Conroy et al. | 192/12 C |
| 4,056,177 | 11/1977 | Ahlen et al. | 192/0.032 |

FOREIGN PATENT DOCUMENTS

| | | | |
|---|---|---|---|
| 1142554 | 1/1963 | Fed. Rep. of Germany | 127/19 |
| 1810619 | 5/1970 | Fed. Rep. of Germany | 233/24 |
| 1816020 | 7/1970 | Fed. Rep. of Germany | 233/24 |

*Primary Examiner*—George H. Krizmanich
*Attorney, Agent, or Firm*—Albert C. Johnston; Ronald A. Clayton

[57] ABSTRACT

An improved cyclical centrifugal machine includes a rigid support mounted above the basket of the machine, a bearing housing suspended from the support for gyratory motion, a basket-carrying spindle rotatable in fixed position relative to the housing on bearings therein, and an electric motor for bringing the spindle and basket to rotational speed. The improved centrifugal machine also comprises a system for controlling transmission of torque from the motor to the basket by means of a clutch having relatively rotatable clutch members adapted to transmit torque through liquid films between them. The clutch is operated to vary the torque transmitted from the motor to the basket so as to produce a maximum load to be placed on the motor for producing a desired basket speed. To so operate the clutch, signals proportionate respectively to the instantaneous load on the motor and the instantaneous speed of the basket, and reference signals representing respectively the maximum load to be placed on the motor and the desired operating speed, are compared to produce from them a resultant signal representing the instantaneous relationship of the actual load on the motor to the maximum load. The clutch is then operated to vary the torque transmitted through the liquid films between the clutch members in response to the resultant signal to produce the maximum load.

8 Claims, 8 Drawing Figures

CYCLICAL CENTRIFUGAL MACHINE

The present invention relates to an improved cyclical centrifugal machine that incorporates features for increasing its efficiency and for making its operation more safe. Such machines are used to separate liquid from solids in large scale industrial processes and have particular application in the manufacture, refining and drying of sugar, dextrose, and other crystalline or granular materials.

Centrifugal machines of this type usually include a large rotary cylindrical basket that is carried on a spindle rotatable on bearings in a fixed position relative to a bearing housing that is suspended in a rigid support mounted above the basket. A rotary prime mover, ordinarily an AC induction motor, rotates the spindle and basket at high speed to centrifugally separate liquid from solids in the basket. The motor is also operable on the spindle and basket to rotate them at lower speeds during different phases of cyclical machine operation.

The electric motor may either be directly connected to the spindle or may be connected thereto through a slip coupling such as a mechanical clutch or a hydraulic coupling. In conventional heavy centrifugal machines in which the motor is directly connected to the spindle, high centrifuging basket speed is achieved by first energizing the motor on a low speed winding, the motor and the basket then being simultaneously accelerated to approximately the low synchronous speed of the motor. When the low synchronous speed is approached, the low speed motor winding is deenergized and a high motor speed winding is energized. Again, the basket and motor are simultaneously accelerated to approximately the high synchronous speed of the motor. In such an operation, a substantial portion of power supplied to the motor is dissipated therein as heat, also called "slip energy". Special provision usually is made in such a motor to permit it to withstand high thermal loads when operated in this manner.

A principal object of the present invention is to provide a heavy cyclical centrifugal machine that includes a system for controlling transmission of torque from the electric motor to the basket of the machine to maximize acceleration of the basket without overheating the motor.

It is another object of the present invention to provide such a centrifugal machine in which the system for controlling transmission of torque from the motor to the basket minimizes heat energy losses in the motor and dissipates heat which is produced upon acceleration of the basket at a location remote from the motor.

It is another object of the present invention to provide such a centrifugal machine that can use a relatively low cost motor not having the high thermal loading capacity previously required for motors in conventional centrifugals but which is, nevertheless, capable of producing high basket acceleration and speed and, therefore, high centrifuging efficiency.

In its preferred embodiment, the improved cyclical centrifugal machine of the present invention includes a rigid support mounted above the basket of the machine, a bearing housing suspended from the support for gyratory motion, a basket-carrying spindle rotatable in fixed position relative to the housing on bearings therein, and an electric motor for bringing the spindle and basket to rotational speed.

The system for controlling transmission of torque from the motor to the basket includes a clutch that comprises relatively rotatable confronting clutch members adapted to transmit torque through liquid films between them. One set of clutch members is rotatable with the motor and a second set of the clutch members is rotatable with the basket. Passageways are provided to circulate liquid under pressure to and between the clutch members for torque transmission and from the clutch members for dissipation of heat from the liquid. A piston is reciprocably mounted in a cylinder and is actuated by pressurized gas to operate one set of clutch members to displace them relative to the second set of clutch members to vary the torque transmitted through the liquid films.

A transformer energized by current flow to the motor generates a control circuit proportionate to the current drawn by the motor and produces therefrom a control voltage which constitutes a load signal proportionate to the load on the motor during its operation. A toothed gear is mounted for rotation with the basket and a magnetic pick-up is mounted adjacent and responsive to rotation of teeth of the gear for generating a pulsating voltage constituting a speed signal having a frequency proportionate to the speed of the basket. Means are provided for generating a load reference signal representative of a maximum load to be placed on the motor for producing a desired basket speed. Further means are provided for generating a speed reference signal representing the desired basket speed. An amplifier circuit compares the respective signals and produces from them a resultant signal representing at any given moment the relationship of the actual load on the motor to the maximum load. A control circuit is responsive to the resultant signal to control flow of pressurized gas to the cylinder to operate the piston and, thus, to vary the torque transmitted from the motor to the basket so as to produce the maximum load on the motor.

Accordingly, the torque transmitting system of the present invention operates the motor within its maximum load capability so as to achieve maximum acceleration to the desired speed of the basket.

In accordance with the present invention, the motor may also be operated sequentially in low and high speed winding to bring the basket to a desired high speed. Specifically, the machine of the invention is operated as follows:

Liquid is first circulated to the clutch to form liquid films between the confronting clutch members. The motor is energized on the low speed winding to bring it to low synchronous speed and, then, the clutch is operated to increase the torque transmitted through the liquid films between the confronting clutch members from the motor to the basket. When the speed of the basket approaches the low synchronous speed of the motor, the clutch is operated to discontinue transmission of torque through the liquid films. The motor is then energized on the high speed winding to bring it to its high synchronous speed. Again, the clutch is operated to increase the torque transmitted from the motor to the basket until the speed of the basket approaches the high synchronous speed of the motor. The liquid is circulated from the clutch to dissipate heat generated therein during the operations described above.

Other objects, features and advantages of the present invention will appear from the following detailed description of exemplary embodiments thereof and from the accompanying drawings illustrating said embodiments.

Figure 1:
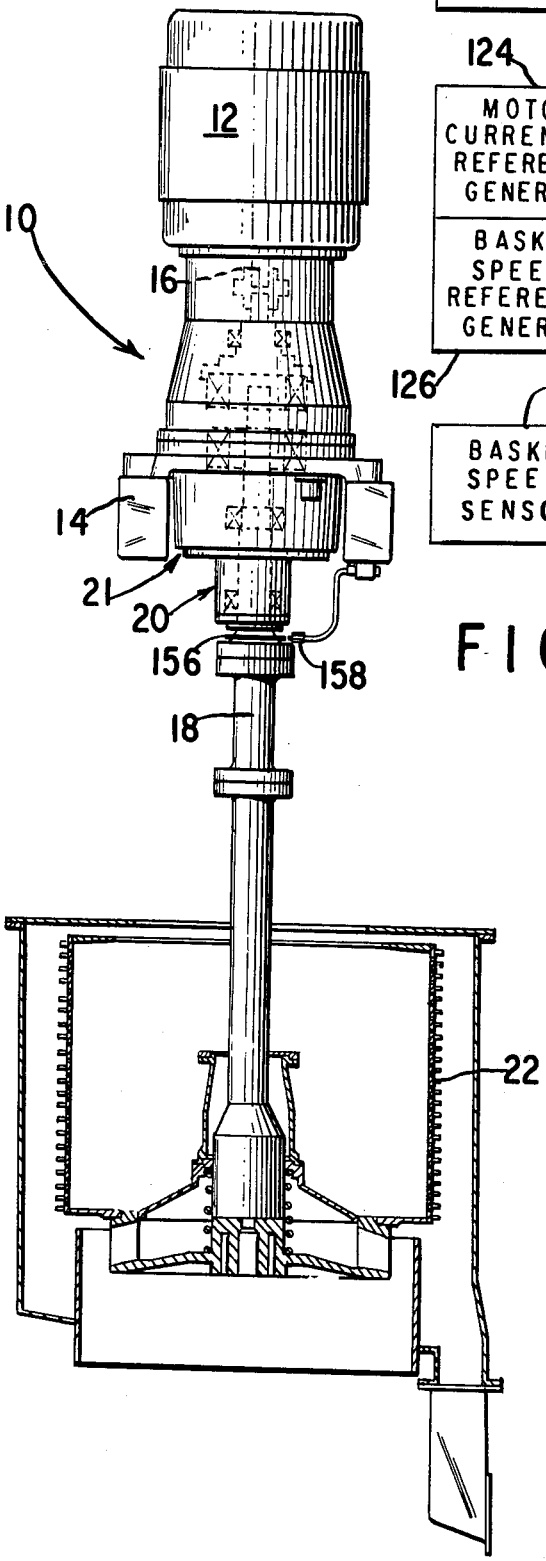
FIG. 1 is a side elevational view, partly in vertical cross-section, of a cyclical centrifugal machine constructed in accordance with the preferred embodiment of the present invention.

FIG. 1 illustrates a heavy cyclical centrifugal machine, generally indicated at 10, incorporating improved features in accordance with the present invention. The centrifugal machine comprises a rotary prime mover, in the form of a large electric motor 12, mounted on a rigid fixed support 14, only a part of which is shown in the interest of clarity. The shaft 16 of the motor is coupled to a spindle 18 mounted in a fixed position for rotation in a bearing housing 20 that is vertically suspended for gyratory motion in a suitable head 21 mounted in support 14. At its bottom end, the spindle carries a large centrifugal basket 22 that is rotated by the electric motor 12 at different speeds during the operation of discharging solids from the basket or during loading of the basket. The windings may be serially energized to bring the basket to high top centrifuging speed, as will be described in greater detail below.

Figure 2:
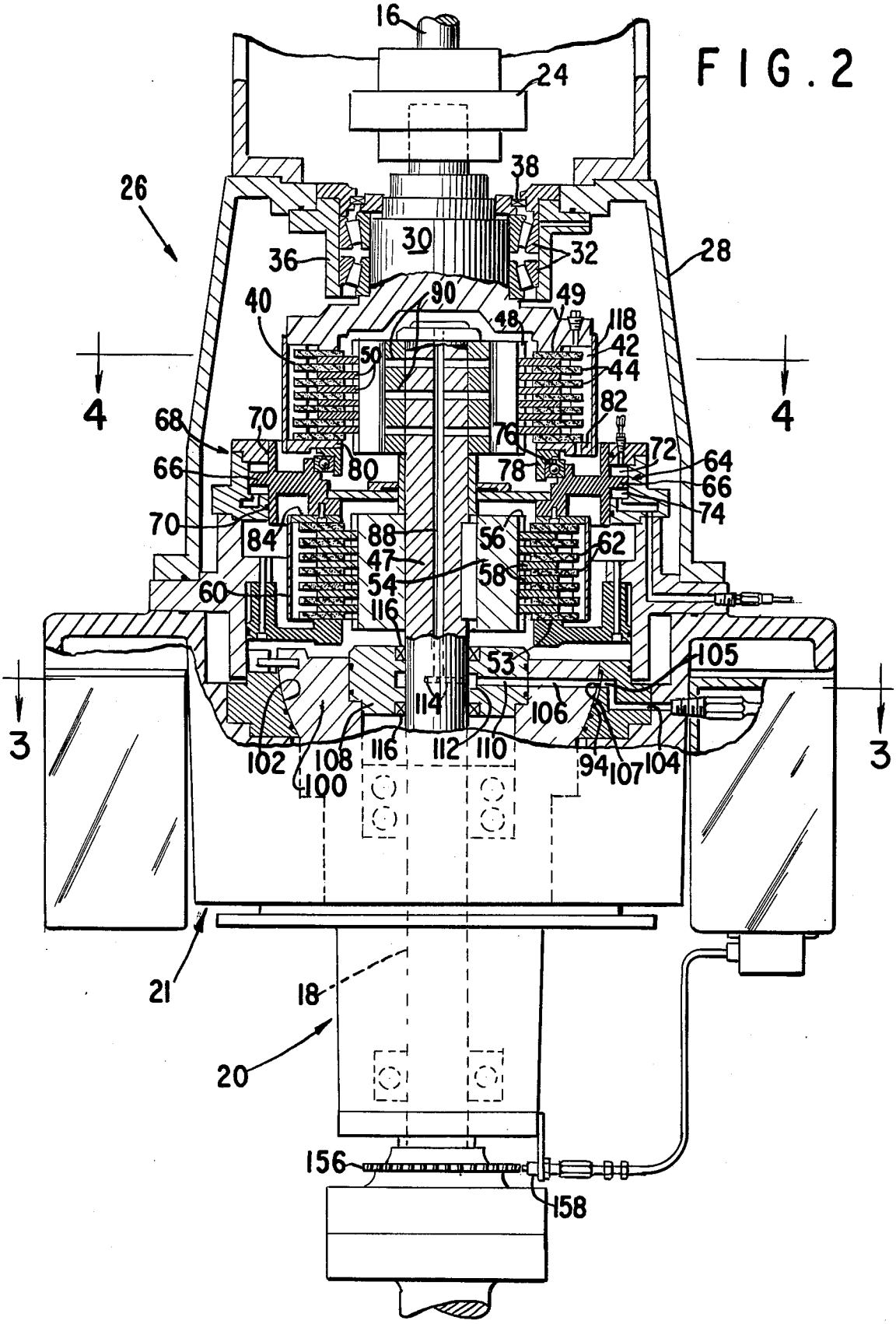
FIG. 2 is an enlarged side elevational view, also partly in cross-section, showing the clutch for transmitting torque through liquid films from the electric motor to the basket-carrying spindle.

Referring now to FIG. 2, it can be seen that the motor shaft 16 is connected through a suitable flexible coupling 24 to a clutch/brake unit, generally indicated at 26, which is in turn connected to the spindle 18. The clutch/brake unit, which may advantageously be a "Posidyne" clutch/brake unit available from Force Control Industries, Inc., Hamilton, Ohio, transmits torque from the motor shaft 16 to the spindle 18 through liquid films continuously circulated and replenished between confronting clutch members. Specifically, the unit 26 includes an input shaft 30 that is supported in a housing 28 by spherical roller bearings 32 mounted in a cylindrical insert 36 extending axially inwardly of the housing 28. A suitable seal 38, which permits rotation between the input shaft 30 and cylindrical insert 36, is provided.

Figure 4:
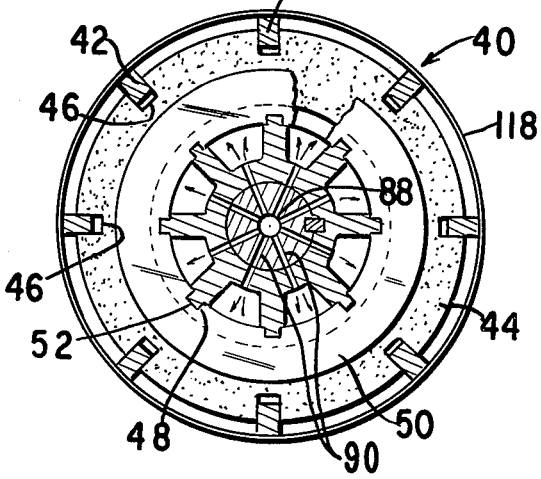
FIG. 4 is a second horizontal cross-sectional view taken through plane 4—4 in FIG. 2 illustrating confronting clutch members and a further portion of the system for circulating liquid to and between the clutch members.

The clutch portion of the clutch/brake unit comprises a cylindrical cage 40 mounted for rotation with the input shaft 30 and having a series of axially extending, radially inwardly protruding dogs 42 formed on its inner cylindrical surface, as can be seen in FIG. 4. A plurality of annular drive discs 44 are mounted in coaxial relation within the cage 40, each having a series of radially inwardly extending notches 46 at its outer circumferential edge that are keyed to or interfitted with the radially inwardly extending dogs 42. Accordingly, the drive discs 44 may be positively driven by the motor 12.

The spindle 18 is formed with an upwardly extending section 47 that extends in coaxial relation into the cage 40. The upper spindle portion 47 is further provided with a series of axially extending, radially outwardly projecting splines 48 about its cylindrical outer surface. A plurality of annular driven discs 50 are mounted on the splined upper section 47 of the spindle, each disc having a series of radially outwardly extending notches 52 formed on its inner annular surface and keyed to or interfitted with splines 48 as shown in FIG. 4. Accordingly, the driven discs are mounted for positive rotation with the spindle. The drive and driven discs, which are mounted in alternating confronting relation, each drive disc being adjacent at least one driven disc and vice versa, collectively constitute a clutch disc stack, the uppermost drive disc of which abuts a first radially extending stop surface 49 at the top of the cage.

The dogged and splined arrangements for keying each of the drive and driven discs respectively to the cage 40 and upper portion 47 of the spindle permit the discs to be axially displaced relative to one another so that the entire clutch disc stack may be axially compressed against the stop surface 49 or expanded away from it to vary the torque transmitted from the motor to the spindle.

The upper section 47 of the spindle also includes a lower portion 54 formed with a series of radially outwardly directed, axially extending splines 56. A second set of driven discs 58 is keyed to the lower splined section 54 in a fashion similar to that described with reference to the first set of driven discs 50. A second cylindrical cage 60 is mounted in non-rotative relation with the housing 28 and a plurality of non-rotating discs 62 are keyed thereto in a fashion similar to that described with reference to the plurality of drive discs 44 mounted in the rotatable cage 40. The lowermost non-rotating disc abuts a radially directed lower stop surface 53. The second set of driven discs 58 and the non-rotating discs 62 constitute a brake disc stack which is axially compressible against the stop surface 53 and expandable away from it.

A double-acting piston 64 actuated by pressurized gas, such as compressed air, is mounted between the clutch and brake disc stacks of the clutch/brake unit. The piston includes a radially outwardly directed annular flange portion 66 that is mounted for axial reciprocal movement in a cylinder 68 and includes appropriate O-ring seals 70 for rendering upper and lower chambers 72 and 74, defined between the flange portion and cylinder, pressure tight. On its upper surface, the piston 64 supports a bearing 76 that in turn supports an annular pressure applying ring 78 having a radially outwardly directed portion 80 that supports a pressure disc 82 which abuts the lowermost drive disc. The ring 78 and disc 82 are permitted to rotate with the clutch disc stack by the bearing 76 while the piston remains non-rotative in relation to the support. Accordingly, when the piston 64 is reciprocated upwardly in a manner to be described below in detail, the clutch disc stack is compressed against the upper stop surface 49.

A second pressure applying ring 84 is bolted to the lower section of the piston 64 and abuts the uppermost non-rotating disc 62. Accordingly, when the piston is reciprocated downwardly, the brake disc stack may be compressed against the lower stop surface 53.

The piston is reciprocated by compressed air fed to the upper and lower chambers 72 and 74 defined between the piston and cylinder. The compressed air fed to the upper chamber 72 moves the piston downwardly to compress the brake disc stack and compressed air fed to the lower chamber 74 moves the piston upwardly to compress the clutch disc stack. Conversely, when one disc stack is compressed, the other is permitted to expand.

Liquid, such as varcous transmission oil, is circulated to both the clutch and brake disc stacks to establish liquid films between the respective driven and drive discs of the clutch stack and driven and non-rotating discs of the brake stack. This liquid reaches the respective stacks through an axial passage 88 formed in the upper portion 47 of the spindle 18 and a plurality of radially outwardly directed branches 90 that lead from the axial passage to the inner peripheries of the respective disc stacks.

Further, as can be seen in FIG. 2, the bearing housing 20 in which the spindle 18 is rotatably mounted is formed at its upper end with a partially spherical ball 100 that mates with and is supported in a similarly partially spherical socket 102 formed in the gyratory head 21. Liquid is fed to the axial passage 88 in the upper section 47 of the spindle 18 through a passage 104 extending generally radially in the gyratory head and terminating in a first port 105 opening within the socket 102. The port 105 communicates with a similar confronting port 107 opening into a radial passage 106 disposed through the ball of the bearing housing 20. Suitable O-rings 94 provide a liquid seal at the interface between the ball and socket at locations bounding the passages 104 and 106. A bushing 108 for the spindle is mounted at the top of housing 20, and also has a radial passage 110, communicating with the passage 106 that terminates at its inner end in an annular channel 112. Three radial passages 114 spaced apart by approximately 120 degrees are disposed in the spindle and communicate with the axial passage 88 as well as the annular channel 112. Suitable seals 116 are provided between the bushing 108 and the outer cylindrical surface of the spindle to prevent leakage of liquid as it passes from the annular channel 112 to the radial passages 114. Accordingly, liquid supplied to the passage 104 under pressure is fed through interconnected radial passages 106 and 110, annular channel 112 and radial passages 114 to the axial passage 88 in the spindle for ultimate delivery to the inner peripheries of the disc stacks.

A cylindrical oil shield 118 surrounds and is spaced from the driven and drive discs of the clutch disc stack to collect liquid thrown radially outwardly from the discs by centrifugal force. This liquid drips downwardly in the housing to be returned by suitable passageways to a pump (not shown) that supplies the liquid under pressure to the axial passage as described above.

Torque is transmitted through the liquid films between the drive and driven discs of the clutch, the amount of torque so transmitted being determined by the pressure applied by piston 64 to the clutch disc stack and, hence to the liquid films between confronting discs. Heat is generated during acceleration of the basket by the motor in the liquid films and may be dissipated therefrom when the liquid is circulated away from the clutch disc stack. Accordingly, since these "slip energy" losses occur in the liquid circulated between confronting clutch discs, excessive heat is not generated in the motor. Therefore, a lower cost motor, without special provisions previously required for managing heat loading in the motor, may be used in the centrifugal machine of the present invention.

Figure 5:
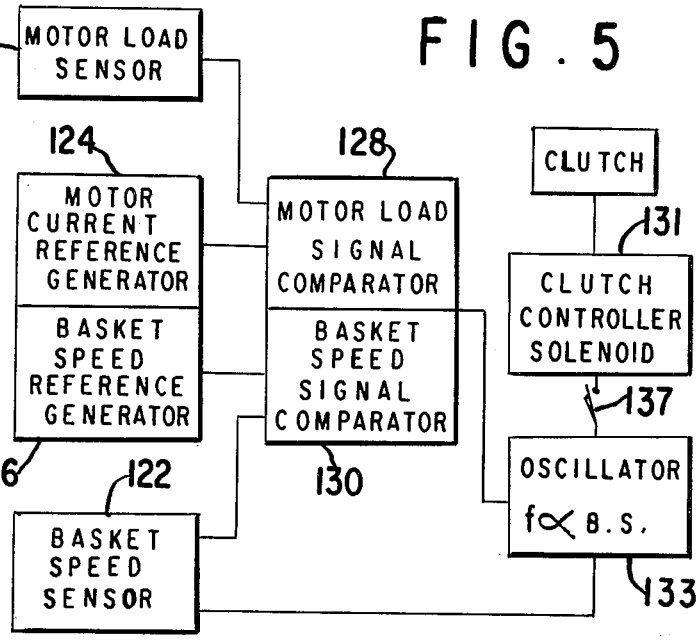
FIG. 5 is a diagrammatic representation of the control circuitry for controlling operation of the clutch to transmit torque from the motor to the basket.
Figure 3:
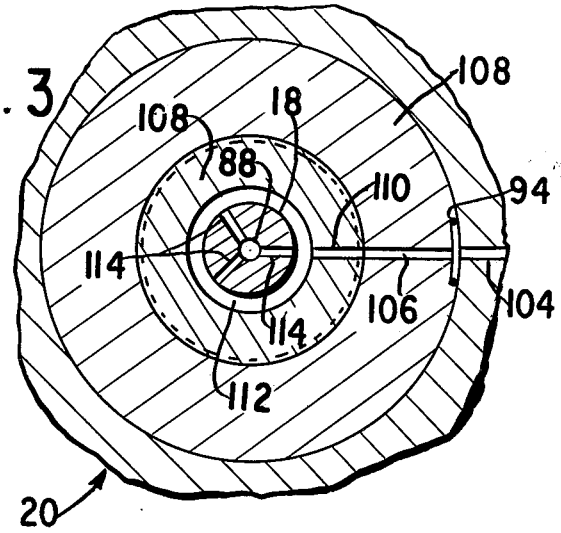
FIG. 3 is a horizontal cross-sectional view taken through plane 3—3 in FIG. 2 showing a portion of the system for circulating liquid to and between the clutch members of said clutch.

The clutch section of the clutch/brake unit described above for transmitting torque from the motor to the spindle through liquid films between the confronting drive and driven discs is controlled to maximize acceleration of the basket while preventing overheating of the motor by dissipating heat generated during basket acceleration from the liquid films circulated between the clutch discs. The system for operating the clutch unit is shown diagrammatically in FIG. 5 and includes a motor load sensor 120 for sensing the instantaneus load on the motor and producing a load signal proportionate thereto. A basket speed sensor 122 senses the speed at which the basket is rotated at any given time and produces a basket speed signal proportionate thereto. A load reference signal representing the maximum load to be placed on the motor to produce a desired basket speed is generated by a motor current reference signal generator 124. For example, the desired speed may be the speed of the basket during that phase of cyclical machine operation when material to be centrifuged is loaded into the basket, the speed of the basket during that phase of cyclical machine operation when centrifuged material is discharged from the basket or the top speed at which the basket is operated when material is centrifuged. The maximum load is that above which unacceptable overheating of the motor may occur. Similarly, a basket speed reference signal generator 126 produces a basket speed signal which represents the desired basket speed. The motor load signal and the motor reference signal are compared by a motor load signal comparator 128. Similarly, the basket speed reference signal and the basket speed signal are compared by a basket speed signal comparator 130. The respective signal comparators produce error signals representative of the magnitude of difference between the respective compared signals that are integrated to produce a combined error or resultant signal. The resultant signal is applied to an oscillator 133 which is also connected to the basket speed sensor. The oscillator generates a pulsating signal having a frequency which is modified by the sensed basket speed. The pulse width of the pulsating oscillator signal is modulated in accordance with the resultant signal. This frequency and pulse width modulated oscillator signal is then conducted through a normally closed clutch cut-out 137 to control a clutch controller 131 in the form of a clutch solenoid valve that, in turn, controls the flow of pressurized gas to the clutch disc stack actuating piston 64.

Accordingly, the signal driving the solenoid valve has constant magnitude but a variable pulse width. The pulse frequency and width determine the length of time during which the solenoid is operated to control pressure applied to the clutch disc stack and hence the torque transmitted from the motor to the spindle and basket. Because the resultant signal is an instantaneous measure of the difference between the actual and desired motor loads and the actual and desired basket speeds, the clutch is operated to transmit torque from the motor to the spindle so as to produce the maximum torque on the motor, thereby producing rapid acceleration to the desired basket speed.

The oscillator circuit is also available from Force Control Industries, Inc.

Figure 6:
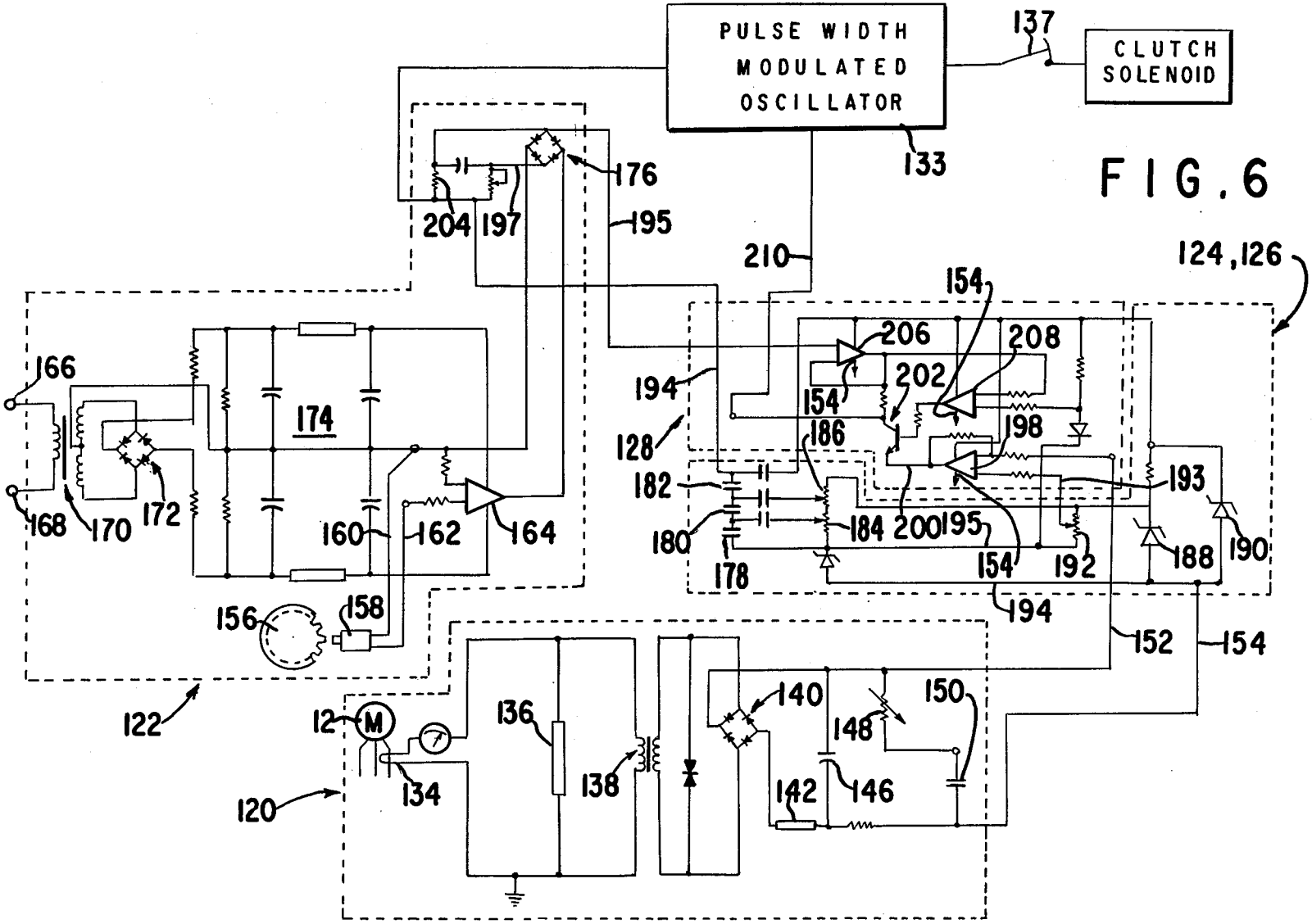
FIG. 6 is a schematic diagram of the control circuitry.

Details of this system for controlling the clutch section of the clutch/brake unit, generally described above, are illustrated in FIG. 6. As shown there, the motor load sensor 120 comprises a transformer 134 which is energized by current flow to the motor to produce a control current proportionate to the current drawn by the motor and thus representative of the load thereon. Alternatively, the current flow to the motor may be used to energize a watt meter to produce a signal representing the load on the motor. This control current is conducted through a resistance 136 to provide a voltage drop that is proportionate to the current flowing from the transformer. The voltage drop is transformed by a transformer 138, rectified by a bridge rectifier 140 and conducted to an RC filter comprising a resistor 142 and a capacitor 146 to yield an output or motor load voltage signal between lines 152 and 154.

As described above, the motor utilized in the centrifugal machine of the invention has low and high speed windings. As is known, the impedance of the motor changes when switched from one winding to another. Therefore, an adjusting network, comprising a potentiometer 148 and a high speed interlock switch 150, is provided to adjust the load voltage signal to a relationship to the load on the motor when switched to the high speed winding substantially equivalent to the relationship existing between them when the low speed winding of the motor is active. Therefore, the output from the motor load sensor on lines 152 and 154 is maintained at the same relative value for torque produced by the motor whether operated on the low or high speed windings.

The basket speed sensor 122 comprises a toothed gear 156, also shown in FIG. 2, that is mounted on the spindle for rotation therewith. A magnetic pick-up 158 is mounted adjacent and is responsive to rotation to the teeth of the gear for generating a pulsating voltage having a frequency proportionate to the speed of the spindle and basket. The output from the magnetic pick-up on lines 160 and 162 is conducted to an amplifier 164. A line voltage on terminals 166 and 168 is reduced by a transformer 170 for conduction to a bridge rectifier 172, the output of which is filtered by the network generally indicated at 174 and regulated to supply a constant voltage to the amplifier 164. The output of the amplifier is then rectified by a bride rectifier 176 and filtered to provide a direct current speed voltage signal directly proportionate to basket speed on line 197.

The speed reference signal generator 126, shown as a combined circuit with the load reference signal generator 124, includes three relays 178, 180 and 182 that selectively set a speed reference signal, which is based on the output voltage of one of two zener diodes, representative of the desired basket speed for each phase within the cycle of machine operation. Specifically, as noted above, the centrifugal machine is operable at a relatively low speed for discharging solids from the basket (the discharge speed), a higher speed for loading material into the basket (the loading speed), and a top centrifuging speed (top speed). When relay 178 is conducting and relays 180 and 182 are non-conducting, the discharge speed is selected. Similarly, when relay 180 is conducting and relays 178 and 182 are non-conducting, the loading speed is selected. When relay 182 is conducting and relays 178 and 180 are non-conducting, top speed is selected as described below. The loading and discharge speed reference signals may be adjusted by potentiometers 184 and 186, connected respectively through relays 178 and 180, to select a portion of the reference voltage generated by the first zener diode 188. This portion of the voltage is representative of the desired speed to be achieved by the basket during each such phase of cyclical operation. The top speed reference signal is based on the output voltage of a second zener diode 190. The selected output from one of the three relays accordingly appears as a voltage or the speed reference signal on line 194.

A limit reference set potentiometer 192 selects a portion of the voltage generated by the zener diode 188 as the motor load reference signal on line 193 and they collectively, therefore, constitute the load reference signal generator 124.

The motor load signal or voltage across lines 152 and 154 is compared with the load reference signal on line 193 by an amplifier 198 having both of these signals as inputs. In the absence of current drawn by the motor, or motor load, the amplifier is turned "on". As the current drawn by the motor and, hence the motor load, increases, the output of the amplifier decreases until the motor load signal or voltage approaches the motor load reference signal or voltage turning the amplifier "off". The output of amplifier 198 is conducted on line 200 to an emitter of a transistor 202.

A resistor 204 combines the speed reference signal or voltage on line 194 and the speed signal from rectifier 176 on line 197 and produces a combined speed error signal on line 195 that represents any difference in magnitude between the respective signals. The combined speed error signal is conducted on line 195 to an impedance matching amplifier 206 and then to a second amplifier 208, the output of which is connected to the base of the transistor 202. The output of the collector of transistor 202 appears on line 210 and is a combined error or resultant signal representing the combined speed reference signal, motor load reference signal, basket speed signal and motor load signal.

The collector of transistor 202 is connected to the oscillator 133. The resistor 204 which receives the basket speed signal on line 197 and the speed reference signal on line 194 is also connected to the oscillator which operates as described above to control the clutch solenoid valve.

Figure 7:
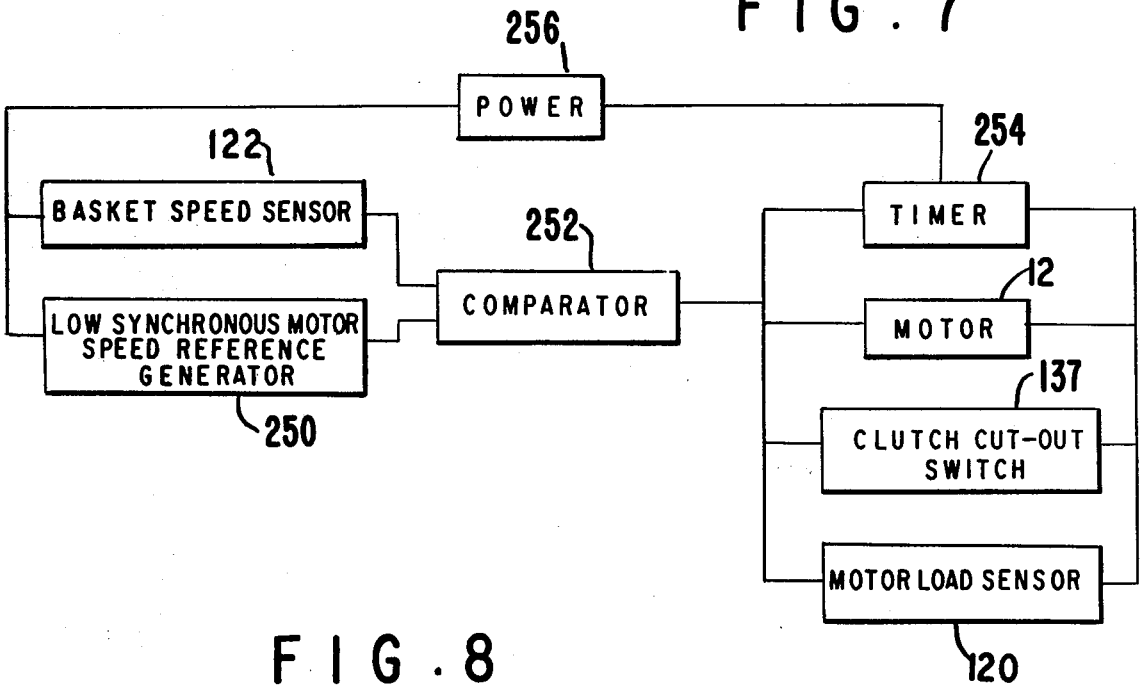
FIG. 7 is a diagrammatic representation of circuitry for switching the motor from its low to its high speed winding.

The system for controlling switching of the motor from its low to its high speed winding when the centrifugal machine is brought to its top speed is shown in FIG. 7. This system includes the basket speed sensor 122 which comprises the toothed gear 156 mounted with the basket-carrying spindle, and the magnetic pickup 158. The system further comprises a low synchronous motor speed reference generator 250 and, a comparator 252 for comparing the low synchronous motor speed reference with the basket speed. The comparator is connected to a timer 254 as well as to the motor 12, the clutch cut-out switch 137 and to the motor load sensor 120. This system operates as follows. When the machine is turned on or at the inception of a top speed cycle, power from a power supply 256 is turned on activating the timer 254 as well as the remainder of the control circuitry including the basket speed sensor 122 and the low synchronous motor speed reference generator 250. Because the characteristics of the motor are known, the time required for it to reach low synchronous speed without load is also known. This time is preset by the timer 254. After this known time, the timer signals the clutch cut-out switch 137 to close and the high speed interlock switch 150 in the motor load sensor to open. Accordingly, torque begins to be applied from the motor to the basket through the clutch unit under control of the control circuitry shown in FIG. 6 as described above and the basket speed, sensed by the basket speed sensor also increases. When the basket speed approximately equals the low synchronous motor speed as represented by the reference generator 250, the comparator 252 resets the timer 254 in order to open the clutch cut-out switch 137 and close the high speed interlock 150. The motor is then deenergized on its low speed winding and also energized on its high speed winding. Again, because the characteristics of the motor as well as the portions of the clutch driven by the motor prior to clutch engagement are known, the time required for the motor to accelerate to its high synchronous speed without load is also known. After this time, preset in the timer, the clutch cut-out switch 137 is closed to engage the clutch to transmit torque from the motor to the basket. When operated on both the low and the high speed windings, the motor is controlled in a manner described in detail above to accelerate the basket to its desired speed within the maximum torque capability of the motor. Accordingly, the centrifugal machine of the invention may be operated to bring the basket to top centrifuging speed without overheating the motor in a manner as follows:

The motor is first energized on low speed winding to bring it to low synchronous speed. The clutch is then operated as described above to increase the torque transmitted from the motor to the spindle without overheating the motor until the basket speed approaches the low synchronous speed of the motor; the clutch is then disengaged, the low speed motor winding deenergized, and the high speed winding energized to bring the motor to high synchronous speed without load. Again, the clutch is operated as described above to increase torque transmitted from the motor to the basket until the basket approaches the high synchronous speed to centrifuge the material in the basket. During this sequence, liquid is, of course, circulated to and from the clutch to dissipate heat generated upon basket acceleration, as described above.

In actual practice, it has been found that it is best to choose some speed of the basket actually less than the low synchronous speed of the basket at which to switch to the high speed winding. This speed may be five percent less than low synchronous speed, for example.

Figure 8:
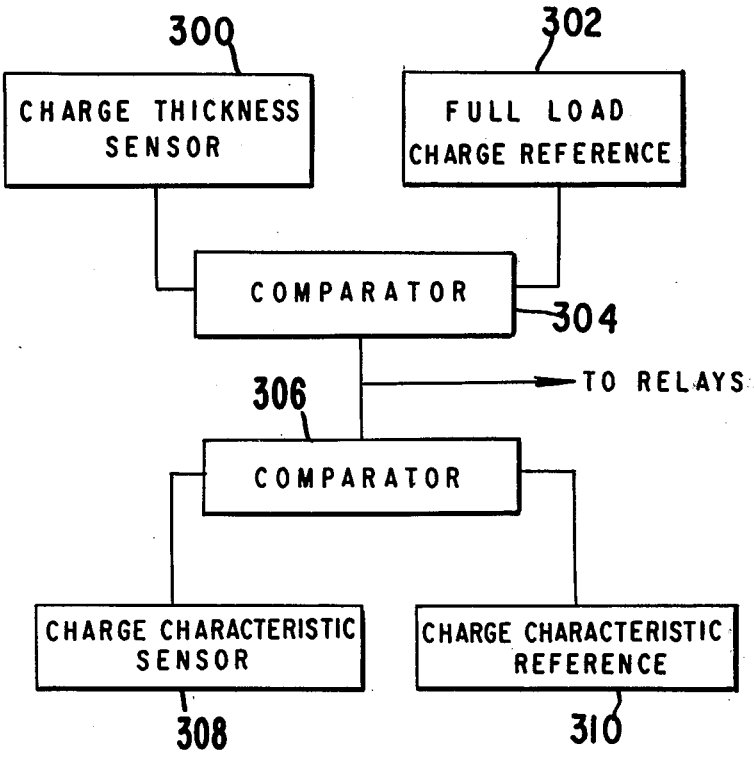
FIG. 8 is a diagrammatic representation of circuitry for switching the control circuitry to operate the centrifugal machine at one of several speed conditions.

FIG. 8 diagrammatically illustrates circuitry for controlling the desired basket speed that the system of the present invention is intended to achieve during different phases of cyclical machine operation. When the machine is initially turned on, it is operated at loading speed and relay 180 is closed while relays 178 and 182 are open. The top centrifuging speed is selected when the loading operation is complete. This is done by means of a charge thickness sensor 300 which may, for example, be a mechanical feeler mounted in the centrifugal basket to sense the thickness of the charge material formed in the charge space against the cylindrical basket wall. The charge thickness is, of course, a measure of the amount of charge in the basket.

The charge thickness sensor and a full load charge reference generator 302 are connected to a comparator 304. When the comparator determines from the signals which it receives that the charge thickness indicates a full basket load, the comparator causes the top speed relay 182 to close and the loading and discharge speed relays 180 and 178 to open respectively.

After the basket has been operated at top speed to perform various functions on the charge loaded therein, including washing and drying of the charge, the relays are actuated to select the discharge speed by closing relay 178 and opening relays 180 and 182. The time at which this switching occurs may be determined by a comparator 306 connected to a charge characteristic sensor 308 and a charge characteristic reference signal generator 310. Typical charge characteristics considered are the time at which the machine is operated at top speed and the dryness of the charge after performance of the top speed centrifuging operation.

Accordingly, it will be appreciated that the centrifugal machine of the invention incorporates significant improvements over prior art machines. More efficient and safe operation results.

Although a specific embodiment of the improved centrifugal machine of the present invention has been described in detail, it is to be understood that this is for purposes of illustration. Modifications may be made to the described structure and method in order to adapt them to particular applications.

What is claimed is:

1. In a cyclical centrifugal machine including a solids retaining centrifugal basket and an AC rotary electric motor for driving the basket, a system for controlling transmission of torque from the motor to the basket comprising:

clutch means including relatively rotatable confronting clutch members adapted to transmit torque through liquid films between them, one set of said members being rotatable with said motor and a second set of said members being rotatable with said basket, means for circulating a liquid to and between said clutch members for torque transmission and from said members for dissipation of heat from liquid, and means for displacing at least one of said sets of said clutch members relative to the other set thereof to vary the pressure applied and thus the torque to be transmitted by said clutch means through said films;

means for generating a load signal proportionate to the load on said motor during its operation;

means for generating a speed signal proportionate to the speed of said basket;

means for generating a load reference signal representing a maximum load to be placed on said motor;

means for generating a speed reference signal representing a desired basket speed;

means for comparing said signals and for producing from them a resultant signal representing at any given moment the relationship of the actual load on said motor to said maximum load; and means responsive to said resultant signal for operating said displacing means and thus varying said torque so as to produce said maximum load on the motor.

2. A centrifugal machine according to claim 1, further comprising a supporting structure defining a partially spherical socket, a bearing housing formed at its upper end with a partially spherical ball interfitted with said socket, said bearing housing thereby being suspended from said supporting structure for gyratory motion; a spindle mounted for rotation in said bearing housing and carrying said basket; said circulating means comprising a first passageway extending generally radially through said supporting structure terminating in a first port opening within said socket, a second passageway extending generally radially through said ball terminating in a second port confronting said first port; and means for establishing a liquid seal between said ball and said socket about said confronting ports.

3. The centrifugal machine according to claim 1, said motor having low and high speed windings, said load signal generating means comprising means responsive to the current flow to said motor for generating a control current proportionate to the current drawn by said motor, means for producing a control voltage from said current, and means operative upon energization of the high speed motor winding for adjusting said control voltage to a relationship to the torque on said motor substantially equivalent to the relationship existing when the low speed motor winding is active.

4. The centrifugal machine claimed in claim 3, said load generating means comprising a watt sensor.

5. The centrifugal machine claimed in claim 3, said current generating means comprising a transformer energized by current flow to said motor.

6. The centrifugal machine claimed in claim 1, said means for comparing said signals comprising:

means including a signal amplifier for comparing said load signal and said load reference signal and generating a load error signal corresponding in magnitude to any difference between the same, means including a resistor for receiving said speed signal and said speed reference signal and for producing a speed error signal corresponding in magnitude to any difference between them; and means for combining said load error signal and said speed error signal and thus producing said resultant signal.

7. In a cyclical centrifugal machine including a solids retaining centrifugal basket and a rotary electric motor for bringing the basket to and driving it at any of several different speed conditions, a system for controlling transmission of torque from the motor to the basket comprising:

clutch means including relatively rotatable confronting clutch members adapted to transmit torque through liquid films between them, one set of said members being rotatable with said motor and a second set of said members being rotatable with said basket, means for circulating a liquid to and between said clutch members for torque transmission and from said members for dissipation of heat from the liquid, and means for displacing at least one set of said clutch members relative to said second set to vary the torque transmitted through said films;

load signal generating means for generating a control current proportional to the current drawn by and thus the load on said motor during its operation;

means for generating a control voltage constituting a load signal from said current;

speed signal generating means comprising a radially toothed gear mounted for rotation with said basket and a magnetic pick-up mounted adjacent and responsive to rotation of the teeth of said gear for generating a pulsating voltage constituting a speed signal having a frequency proportionate to the speed of said basket;

means for generating a load reference signal representing a maximum load to be placed on said motor for producing a desired speed;

means for generating a speed reference signal including selectively settable means for generating a said speed reference signal corresponding to each of said speed conditions, and means for varying the setting of said settable means at appropriate intervals in each operating cycle of the machine;

means including a first signal amplifier for comparing said load signal and said load reference signal and generating a load error signal corresponding in magnitude to any difference between the same;

means including a resistor for receiving said speed signal and said speed reference signal and producing a speed error signal corresponding in magnitude to any difference between them;

means for combining said load error signal and said speed error signal and thus producing a resultant signal representing at any given moment the relationship of the actual load on said motor to said maximum load;

control means responsive to said resultant signal for operating said displacing means and, thus, varying said torque so as to produce said maximum load on the motor.

8. A method for controlling transmission of torque from the electric motor in a cyclical centrifugal machine to the solids retaining basket thereof with clutch means including relatively rotatable confronting clutch members adapted to transmit torque through liquid films between them, said motor having low and high speed windings for bringing said basket to different lower and high rotational speeds, said method comprising the steps of:

circulating liquid to said clutch means to form liquid films between said confronting clutch members;

energizing said motor on said low speed winding to bring it to its low synchronous speed;

operating said clutch members to increase the torque transmitted through the liquid films between them from said motor to said basket;

when the speed of the basket approaches said low synchronous motor speed, operating said clutch members to discontinue transmission of torque through said liquid films;

energizing said motor on said high speed winding to bring it to its high synchronous speed;

operating said clutch members to increase the torque transmitted from said motor to said basket until the speed of said basket approaches said high synchronous motor speed; and circulating said liquid from said clutch means for dissipation of heat from said liquid.

* * * * *